US007012225B2

(12) United States Patent
Bohlender et al.

(10) Patent No.: US 7,012,225 B2
(45) Date of Patent: Mar. 14, 2006

(54) ELECTRIC HEATING APPARATUS WITH HOUSING

(75) Inventors: Franz Bohlender, Kandel (DE); Kurt Walz, Hagenbach (DE)

(73) Assignee: Catem GmbH & Co. KG, Herxheim bei Landau (DE)

( * ) Notice: Subject to any disclaimer, the term of this patent is extended or adjusted under 35 U.S.C. 154(b) by 0 days.

(21) Appl. No.: 10/835,895

(22) Filed: Apr. 30, 2004

(65) Prior Publication Data

US 2005/0056637 A1 Mar. 17, 2005

(30) Foreign Application Priority Data

Sep. 11, 2003 (EP) ..... 03020700

(51) Int. Cl.
*H05B 3/06* (2006.01)

(52) U.S. Cl. ..... 219/536; 219/202; 219/505; 219/530; 219/540; 392/485; 338/306

(58) Field of Classification Search ..... 219/544, 219/545, 546, 547, 548, 202, 485, 530, 505; 338/306, 307, 308, 309, 22 R; 392/485
See application file for complete search history.

(56) References Cited

U.S. PATENT DOCUMENTS

| | | | | |
|---|---|---|---|---|
| 5,219,922 | A * | 6/1993 | Steinberger et al. | 524/785 |
| 5,256,857 | A * | 10/1993 | Curhan et al. | 219/202 |
| 5,777,541 | A * | 7/1998 | Vekeman | 338/22 R |
| 6,178,292 | B1 * | 1/2001 | Fukuoka et al. | 392/485 |

FOREIGN PATENT DOCUMENTS

| | | |
|---|---|---|
| DE | 101 21 568 A | 10/2002 |
| EP | 1 182 908 A | 2/2002 |

* cited by examiner

*Primary Examiner*—Robin O. Evans
*Assistant Examiner*—L Fastovsky
(74) *Attorney, Agent, or Firm*—Boyle Fredrickson Newholm Stein & Gratz S.C.

(57) ABSTRACT

Electric heating apparatus and manufacturing method for an electric heating apparatus, wherein prefabricated constructional units are used. The prefabricated constructional units consist of PTC heating elements fastened to contact sheets by means of a lacquer. This simplifies production and enhances protection against corrosion.

50 Claims, 17 Drawing Sheets

ELECTRIC HEATING APPARATUS WITH HOUSING

BACKGROUND OF THE INVENTION

1. Field of the Invention

The present invention relates to an electric heating apparatus, particularly as an additional or auxialliary heater for automotive vehicles, a constructional unit for such a heating apparatus, and a corresponding manufacturing method.

2. Description of the Related Art

For use in automotive vehicles, particularly automotive vehicles with new, consumption-optimized engines, in which a reduced amount of heat energy is observed, electric additional heaters are used for heating passenger compartment and engine. Such electric heating apparatuses are however also suited for other purposes, e.g. in the field of building installations, particularly room air conditioning, in industrial plants, or the like.

Preferably, PTC heating elements with radiator elements in heat-conducting communication are used for an electric additional heater for an automotive vehicle. The heat generated by the PTC heating elements is discharged via the radiator elements to the air flowing therethrough. The total assembly consisting of a layered structure of PTC heating elements, radiator elements and contact sheets, which serve the supply of power, is kept in a clamp fit within a frame for increasing the efficiency of the heater. Due to the clamping action a high electrical and thermal contacting of the PTC heating elements is achieved.

The layered structure is held within a stable frame having a preferably U-shaped cross-section. The frame is configured such that it compresses the layered structure. The clamping action can alternatively be effected by resilient elements arranged within the layered structure. To enable the frame to absorb the resilient forces, it is made particularly stable from a mechanical point of view. Preferably, it is configured with a U-shaped cross-section. Such a conventional heating apparatus is e.g. known from DE-A-101 21 568.

The minimum height of the longitudinal bars of such a frame with U-shaped cross-section (or C-shaped cross-section according to DE-A-101 21 568) is about 11 mm with respect to the necessary clamping forces. This gives the whole heating apparatus a height of at least 22 mm that cannot be used for the passage of air. Such a constructional shape with exterior clamping action or exterior holding frame has therefore a large area that cannot be used for air throughput. That is why such electric heating apparatuses are not suited for use in the case of very small installation heights.

When electric heating apparatuses with an exterior holding frame or exterior clamping action are assembled, troublesome measures are needed for counteracting the contact pressure forces of the resilient means/frame that are objectionable during assembly.

Due to these drawbacks heating apparatuses with a conventional holding frame for modern air conditioners, especially for installation in automotive vehicles, are less and less suited. Air conditioners for multi-zone air conditioning in a comfort-based automotive vehicle require more and more heating apparatuses of a large length, but small constructional height.

Furthermore, conventional constructions with a holding frame, particularly of metal, have a considerable weight. However, it is desired for installation into automotive vehicles with respect to the total weight of the vehicle that electric additional heaters should be used with a particularly low weight.

A further drawback of metal holder frames is their conductive surface. To enhance the safety in automotive vehicles, metal surfaces are more and more avoided so that it does not pose any risk to touch them, i.e. there is no electrical or thermal conduction. To this end the above-described heating apparatuses are preferably provided with a coating of plastics, as is e.g. the case with the heating apparatus shown in DE-A-101 21 568.

A further drawback of conventional electric heating apparatuses is the risk of corrosion of contact sheets supplying the heating elements with current. The possibility that contact sheets get into contact with moisture exists both during the manufacturing process and during operation. Corrosion between a PTC heating element and a contact sheet made e.g. from aluminum may effect a loss in power of up to about 30%.

OBJECTS AND SUMMARY OF THE INVENTION

It is the object of the present invention to provide an electric heating apparatus, a constructional unit for an electric heating apparatus, and a manufacturing method for an electric heating apparatus with an improved structure and without the above-mentioned drawbacks.

This object is achieved with the features of the independent claims.

According to the invention, one of the contact sheets contacting the PTC heating element is provided with a layer of lacquer during production of the electric heating apparatus. The PTC heating element is "provisionally" fixed to the contact sheet and sealed via said layer of lacquer.

Such a heating apparatus has several advantages. In particular, the lacquer layer that is additionally applied to the electrode provides more protection against corrosion than is achievable in a conventional way. The lacquer protects the contact sheet and the connection between PTC element and contact sheet against penetrating moisture. Corrosion due to moisture with which the contact sheet gets into contact during production or during operation is thus ruled out.

The layer of lacquer is applied during the manufacturing process to the side of an electrode facing the PTC heating elements. The PTC heating elements are subsequently positioned on the layer of lacquer. The lacquer existing between the PTC element and the contact sheet is mainly pressed out by the clamping pressure effected by the resilient element. The pressed-out lacquer seals the space between the PTC heating element and the contact sheet via a bead. An efficient protection against corrosion is possible through this sealing of the transition between the electrode and the PTC heating element.

Moreover, the invention permits a simple production of such an electric heating apparatus. In the pre-finished constructional units, the PTC heating elements are held via the lacquer at predetermined positions on the contact sheet. An individual positioning of the individual elements, particularly the PTC elements, by hand or machine is superfluous during the manufacturing process, and the manufacturing process can be shortened considerably.

Moreover, there is no need to use a position frame or positioning means for keeping the PTC heating elements spaced apart from one another. Due to the pre-fixation of the PTC heating elements via the lacquer, said elements are interconnected in a sufficiently firm way for manufacture.

The mechanical stability of the connection PTC heating element and contact sheet must only last for the manufacturing process. Subsequently, mechanical stability and fixation of the heating elements are effected via the clamping pressure produced by the resilient element. With pre-fabricated constructional units, the manufacturing process can thus be shortened in a simple way.

Preferably, the lacquer is an electrically non-conductive lacquer. This enhances the operational reliability of the heating apparatus because exposed metal surfaces are avoided. At the same time, corrosion of the surface of the contact sheet is prevented. To this end a silicon lacquer is particularly used. Such a silicone lacquer is not only electrically non-conductive, but is also able to compensate the different coefficients of expansion of the PTC heating element and the contact sheet, which is preferably made from aluminum. Therefore, it is particularly advantageous to use an elastic lacquer.

According to a further preferred embodiment, a high-viscosity lacquer is used. The lacquer has a viscosity lower than 900 mPa.s. Such a lacquer can therefore be processed in a particularly advantageous way; for instance a simple application of lacquer by way of a brush type or squeegee type coating, particularly also by way of a drop type coating through commercial dosing devices, is possible. The production of prefabricated constructional units can thereby be simplified in an easy way.

A further simplification of the production can be achieved in that the prefabricated constructional units consist of a radiator element, a contact sheet secured to this element, and the PTC heating element secured to this sheet via the lacquer. With such a larger prefabricated constructional unit, production can be further simplified and accelerated.

According to a preferred embodiment, the contact sheet to which the PTC heating element is secured through the lacquer is made from aluminum. With this material, a particularly efficient heat transition can be achieved between the PTC heating element and the radiator element.

Preferably, the elongated faces are made particularly stable and can thus absorb particularly high forces. To this end transverse struts that receive the clamping forces produced by the resilient element are provided in openings of the elongate faces for the air flowing therethrough. High clamping forces are possible at a small constructional height and with much more lightweight materials, such as plastics. With the construction of the invention, electric heating apparatuses can be used in a more diverse way, especially also when the constructional height that is available is only small.

According to an advantageous development of the invention longitudinal struts are provided in addition to the transverse struts in the openings of the housing sides, so that the struts form a grid structure. As a result, the struts as such can be kept particularly thin, so that they will impede the air throughput only insignificantly and nevertheless prevent deflection or bending of the housing in an efficient way. A housing for an electric heating apparatus can thus be produced in a simple way from a lightweight material, such as plastics, that in addition can be processed easily.

To prevent the air throughput of the air to be heated from being not impeded by the grid struts, the longitudinal struts, in particular, are arranged such that they are positioned in the area of the PTC heating elements. The longitudinal struts are thereby placed such that they coincide in sections where no air throughput takes place.

Preferably, the housing is made of plastics. An essential advantage of a plastic housing is its small weight, its flexible moldability and its low production costs. With this production material, the costs of a heating apparatus can be kept particularly small.

According to an advantageous development of the invention the housing has a lateral opening for insertion of the resilient element after assembly of the heating apparatus. This makes the manufacture of such a heating apparatus much easier because no special devices are needed for overcoming the resilient forces during assembly. The resilient means will only be inserted into the housing when the assembled housing is capable of absorbing the forces produced by the resilient means during compression of the layered structure. The resilient means is preferably guided in a groove. Thanks to the insertion of the resilient means into the housing at a later time without the need to open the housing itself for this purpose, much more lightweight housing materials than the conventional ones can be used, preferably plastics.

According to an advantageous embodiment the housing is composed of two half-shells. This permits a particularly simple assembly of the heating apparatus. To this end the half-shells are configured such that they can be put together. A particularly fast assembly is possible by using locking pins or locking noses effecting a locking of the two half-shells when the half-shells of the housing are put together.

Both half-shells are preferably designed such that they separate the housing approximately in the middle between the opposite housing sides of an open construction. As a result, the housing is particularly stable at the sides of an open construction, and it is only in the middle, i.e. on the separation line of the two half-shells that the housing can absorb either no or only small clamping forces.

In a particular embodiment the two half-shells are provided on their separation lines with additional projections and recesses that engage one another when put together and interconnect the half-shells. Thus the housing can also absorb higher forces in the central area on the separation lines of the two half-shells. The projections and recesses interconnect the two half-shells, thereby effecting an increase in the mechanical stability of the side surfaces. With such a construction, high clamping forces can be used also with housing materials having a basically lower stability.

The resilient element is configured such that it transmits the clamping forces essentially to the reinforced housing sides.

The resilient element consists preferably of a sheet member with obliquely projecting resilient segments. Preferably, the resilient element is made integral with the resilient segments. The resilient means can thus be produced as a continuous member for the first time and supplied from a roll during production. By contrast, every resilient means has to be manufactured separately in the prior art and produced individually for different lengths, whereas the resilient element of the heating apparatus of the invention can be cut to any desired length from a roll in an easy way, so that complicated individual manufacturing processes for the resilient means and adaptations of the manufacturing method upon changes in the construction of the heating element are avoided.

Since housing and resilient means are separated, the thickness of the resilient means of about 0.8 mm in former times can be reduced to a thickness of about 0.3 mm according to the new constructional principle. As a result, the resilient means can be produced with little effort and without any decrease in the efficiency of the heating apparatus.

To achieve a high efficiency of the electric heating apparatus, a resilient segment is provided for each position of a PTC heating element, so that efficiency is improved by an individual clamping of each PTC heating element.

A particularly high efficiency can be achieved by increasing the clamping forces when a plurality of resilient segments, preferably two or three individual resilient segments, are provided in the area of a PTC heating element. As a result, each PTC heating element is held clamped over its total length.

According to a further preferred embodiment the resilient means consist of a sheet member from which individual resilient segments are projecting obliquely in transverse direction, the resilient segments mechanically reinforcing the spring means such that a deflection around the longitudinal axis of the spring means is not possible. To this end the resilient segments extend each into the edge portion of the resilient means so that the resilient means can be supported on the stable outer housing edge. The housing must thus only absorb forces on its edges and can be made less stable in the middle. A particularly lightweight housing material that can easily be processed can thereby be used.

According to a particular development of the electric heating apparatus a seal is provided between the longitudinal struts and the layered structure. Such a seal, particularly as a silicone seal, is preferably made as one part and seals the whole grid structure.

Further advantageous embodiments of the invention are the subject of the subclaims.

BRIEF DESCRIPTION OF THE DRAWINGS

The present invention shall now be explained with reference to preferred embodiments taken in conjunction with the attached drawings, which show in detail in.

DETAILED DESCRIPTION OF THE PREFERRED EMBODIMENTS

Figure 2:
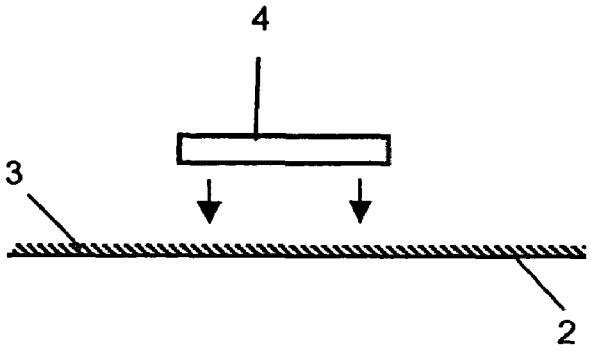
FIG. 2 a schematic illustration of mounting a PTC heating element on a lacquer layer of the contact sheet.
Figure 3:
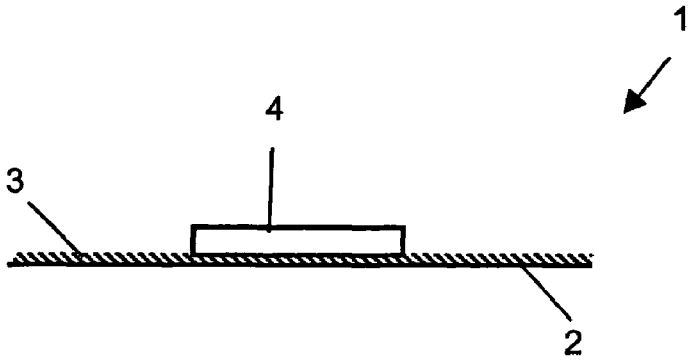
FIG. 3 a schematic illustration of a prefabricated constructional unit consisting of a PTC heating element fixed to a contact sheet.

While in conventional electric heating apparatuses, the PTC heating elements are positioned via positioning means, such as a position frame, between contact sheets, electric heating apparatuses according to the invention are produced such that at least one of the contact sheets is provided with a lacquer layer and the PTC heating elements are positioned thereon prior to assembly in the electric heating apparatus. Said manufacturing steps are shown in FIGS. 1 to 3 in an illustrative manner.

Figure 1:
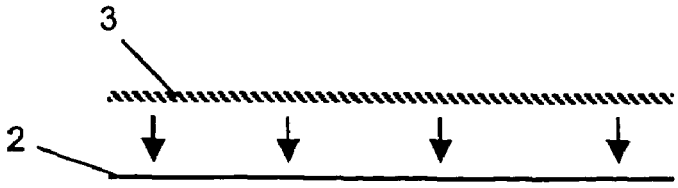
FIG. 1 a schematic illustration of the application of a lacquer layer on a contact sheet.

FIG. 1 is a schematic side view of a contact sheet 2 provided with a lacquer layer 3 at the side later facing the PTC heating element. Subsequently, the PTC heating element 4 is mounted on said lacquer layer 3 (FIG. 2). The contact sheet 2 with the lacquer layer 3 and the PTC heating element 4 arranged thereon form a prefabricated constructional unit 1, which is schematically shown in FIG. 3.

The firmness of the fixation of PTC heating elements 4 via the lacquer 3 on the contact sheet is designed such that they adequately withstand mechanical loads occurring up to or during manufacture of an electric heating apparatus. Said fixation cannot withstand stronger mechanical loads. Manufacture of electric heating apparatuses can be simplified considerably via such a lacquer layer 3 having the PTC heating elements 4 mounted thereon. Particularly, the number of the parts to be mounted can be reduced through constructional units 1 prefabricated in this way. Moreover, the assembly is simplified because the individual elements need not be positioned in a troublesome way within a housing. Moreover, no positioning means are needed because the PTC heating elements are held at a specific position during insertion.

A special advantage achieved with the lacquer is improved protection against moisture. The additional sealing of the connection PTC heating element 4 and contact sheet 2, which can be achieved during assembly of the heating apparatus, will be described hereinafter with reference to FIG. 5.

Figure 4:
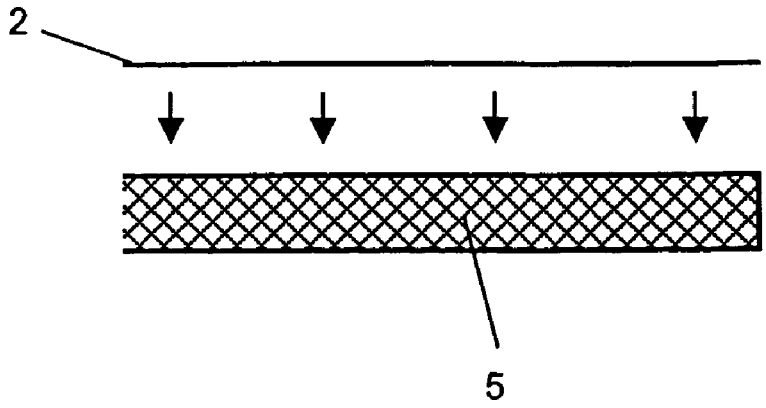
FIG. 4 an alternative embodiment of a prefabricated constructional unit which as a supplement to the elements of FIG. 3 comprises a radiator element.

A variant of a prefabricated constructional unit is shown in FIG. 4. A radiator element 5 is additionally fastened to the contact sheet 2. Said prefabricated constructional unit, in which a PTC heating element 4 according to the production process illustrated in FIGS. 1 to 3 is fastened to the contact sheet 2, permits a further reduction of the mounting steps required during fabrication of an electric heating apparatus because a separate insertion of the radiator elements 5 is not necessary.

According to a further embodiment, other elements of the heating apparatus can subsequently be integrated on the radiator element 5 into the prefabricated constructional element. With each additional element of the prefabricated constructional unit, the number of the manufacturing steps required during fabrication of the heating apparatus decreases.

Figure 5:
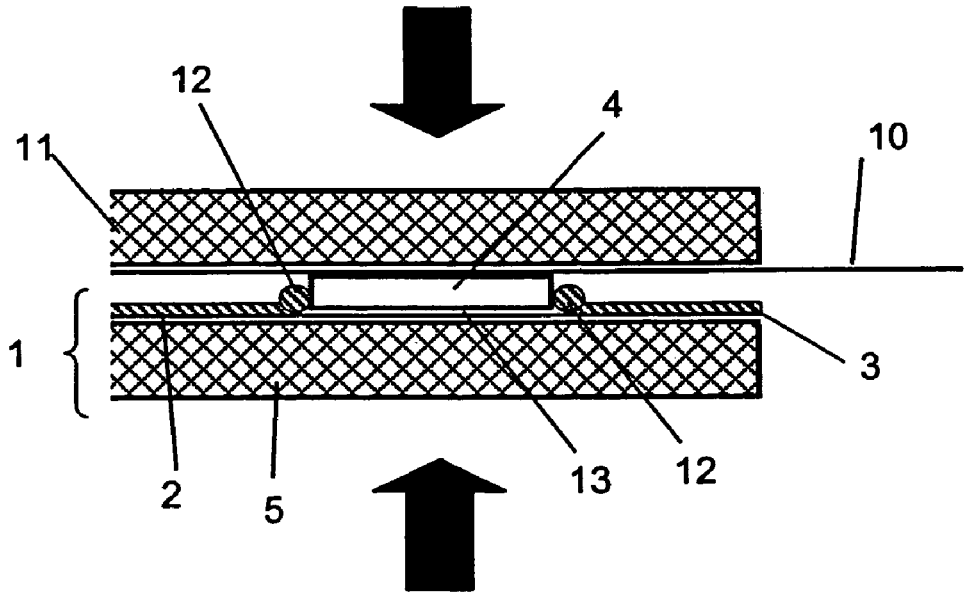
FIG. 5 a schematic illustration of a section of a heating apparatus according to the invention with a prefabricated constructional unit of FIG. 4 inserted thereinto.

During installation of the prefabricated constructional unit 1 according to the invention (according to FIG. 4) into a housing of the heating apparatus, the individual elements of the heating apparatus are held biased via a clamp fit after installation of a resilient element (not shown in FIGS. 1 to 8). A section of an electric heating apparatus of the invention, which shows the clamp fit and its action, is illustrated in FIG. 5.

In addition to the prefabricated constructional unit 1 of FIG. 4, which consists of radiator element 5, contact sheet 2, lacquer layer 3 and PTC heating element 4, FIG. 5 shows a contact sheet 10 adjoining the PTC heating element 4 and a further radiator element 11 adjoining said contact sheet 10. The contact pressure effected by the clamp fit is symbolized by black arrows in FIG. 5. The contact pressure has the effect that the lacquer 3 provided between the PTC heating element 4 and the contact sheet 2 is pressed out at the sides of the space 13 between the PTC heating element 4 and the contact sheet 2. The lacquer pressed out of the space 13 forms lacquer beads 12 on the outer edges of the space 13, the beads 12 sealing the space 13 against penetrating moisture.

The heating apparatus of the invention is efficiently protected via the coating of the contact sheet with a lacquer layer, and the resulting sealing of the contact point PTC heating element and contact sheet, against damage caused by moisture, particularly corrosion, and against loss in power associated therewith. The heating apparatus according to the invention is thus particularly suited for extreme conditions of use where the risk is particularly high that the heating apparatus will come into contact with moisture.

Preferably, an electrically non-conductive lacquer is used for lacquer 3. Since the components of the heating apparatus are pressed during the manufacturing process, the lacquer is pressed out of the space 13, thereby establishing an electrically conductive contact between contact sheet 2 and PTC heating element 4.

The thickness of the lacquer application is preferably within a range between 10 and 20 $\mu l/cm^2$, particularly preferably in the range of 14 $\mu l/cm^2$.

The lacquer 3 can be applied in a simple way by a brush type, squeegee type or drop type coating. Said coating is made possible through a particularly high viscosity, which is preferably within the range of 900 mPa.s to 750 mPa.s. Particularly preferably, the lacquer has a viscosity of about 850 mPa.s. The lacquer forms a permanent coating as a protection against moisture and atmospheric pollutants.

During application of the lacquer via a drop type coating, said lacquer is applied dropwise through a commercial dosing device. Preferably, a dosing needle serves as the dosing device.

To this end a high-viscosity lacquer has to be used. To promote environmental compatibility, a lacquer is used that contains only a small amount of solvents.

According to a preferred embodiment, the contact sheet 2 is made from aluminum. Aluminum permits a particularly efficient thermal transition between the PTC heating element 4 and the radiator element 5.

Preferably, the contact sheet 10, which contacts the PTC heating element 4 at the side opposite to the contact sheet 2, is made from brass, preferably tin-plated brass.

Figure 6:
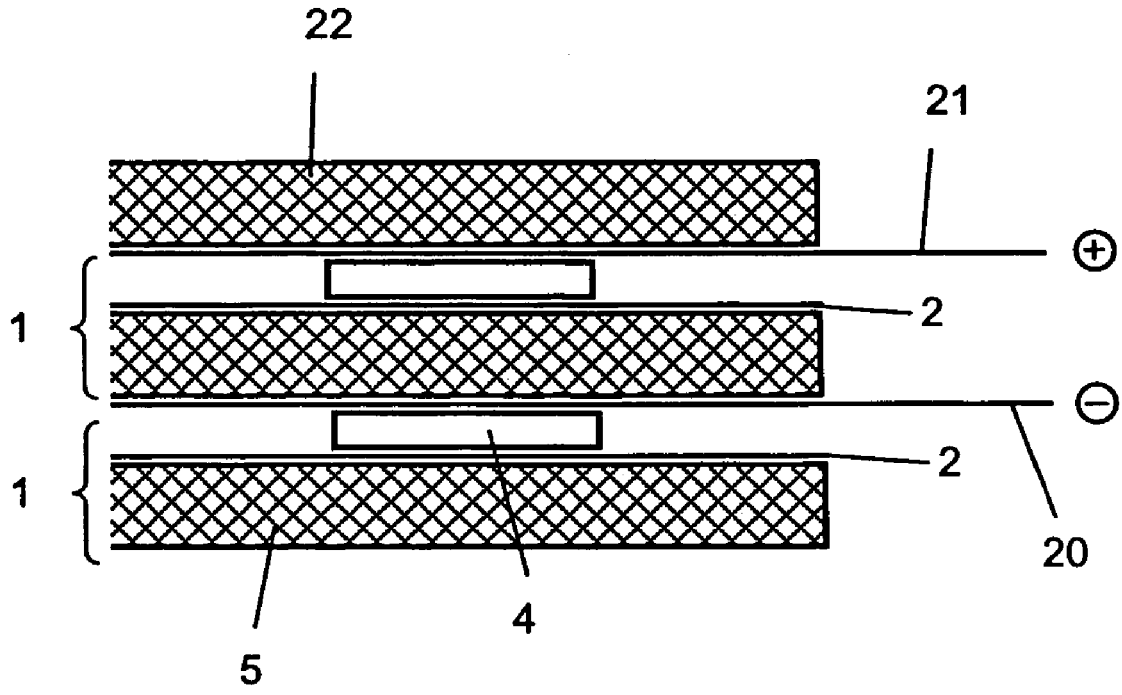
FIG. 6 a schematic view of an internal build-up of a heating apparatus according to the invention.

FIG. 6 schematically shows a preferred embodiment for the components of the heating apparatus of the invention held by clamping. The construction comprises two prefabricated constructional units 1, each having at least one PTC heating element 4, a contact sheet 2, and a radiator element 5. Moreover, the construction comprises further contact sheets 20, 21 adjoining the opposite sides of the PTC heating elements 4, and a completing radiator element 22. The two contact sheets 20 and 21 are here at a different potential. Moreover, the lower radiator element 5 shown in FIG. 6 is connected to a power supply with plus potential.

On the whole, the internal structure of an advantageous embodiment of the heating element of the invention as shown in FIG. 6 only comprises five components to be mounted, namely two prefabricated constructional units 1, two contact sheets 20, 21, and an additional radiator element 22. Such a layered construction can thus be made in a particularly simple and rapid way.

Figure 7B:
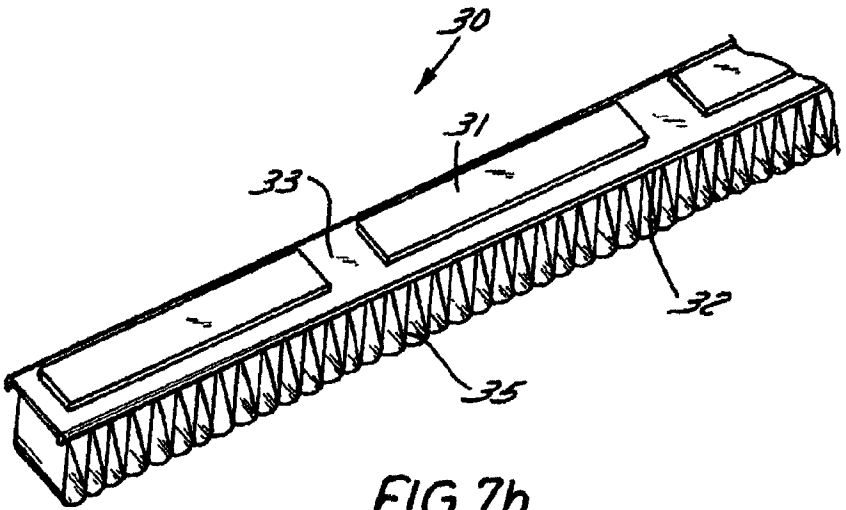
FIG. 7*b* a perspective view of a constructional unit according to FIG. 7*a;*
Figure 7A:
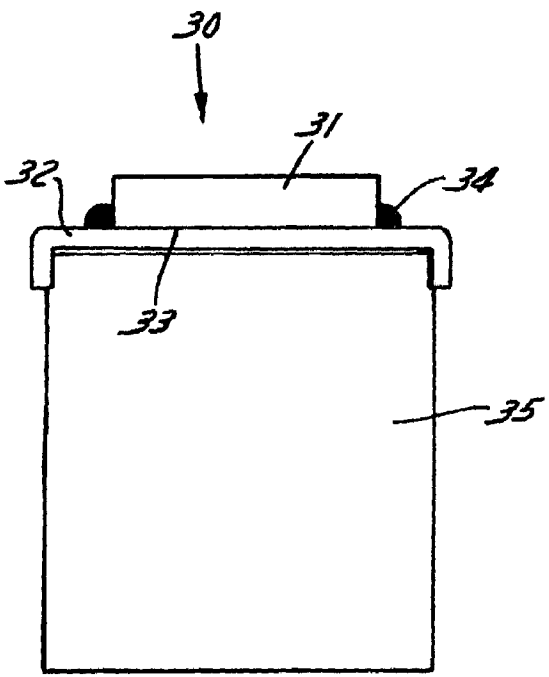
FIG. 7*a* a schematic sectional view through a constructional unit of the invention, consisting of a radiator element, a contact sheet sealed via a lacquer layer, and a PTC heating element arranged on the contact sheet.

FIGS. 7*a* and 7*b* show a perspective view and a sectional view of a preassembled constructional unit 30 in a schematic way. The constructional unit 30 consists of a radiator element 35 which is connected to a contact plate 32. A lacquer layer 33 through which the PTC heating elements 31 are fixed to the contact plate 32 is applied to the contact plate 32.

FIG. 7*a* is a sectional view of the constructional unit 30 which is mounted in a heating apparatus by a clamping action. The lacquer 33 provided between the PTC heating element 31 and the contact plate 32 is pressed laterally out of the space by the clamping pressure, so that the space is sealed or protected via beads 34, the so-called adhesive meniscus, against the penetration of moisture and contaminants.

In contrast to conventional electric heating apparatuses for use in automotive vehicles, the heating apparatus of the invention is composed of two half-shells of plastics. During manufacture one housing half can first be equipped in a simple way and the housing is then completed by mounting the second housing half. The assembly of the electric heating apparatus will be described in the following with reference to FIGS. 12 to 15.

Figure 9:
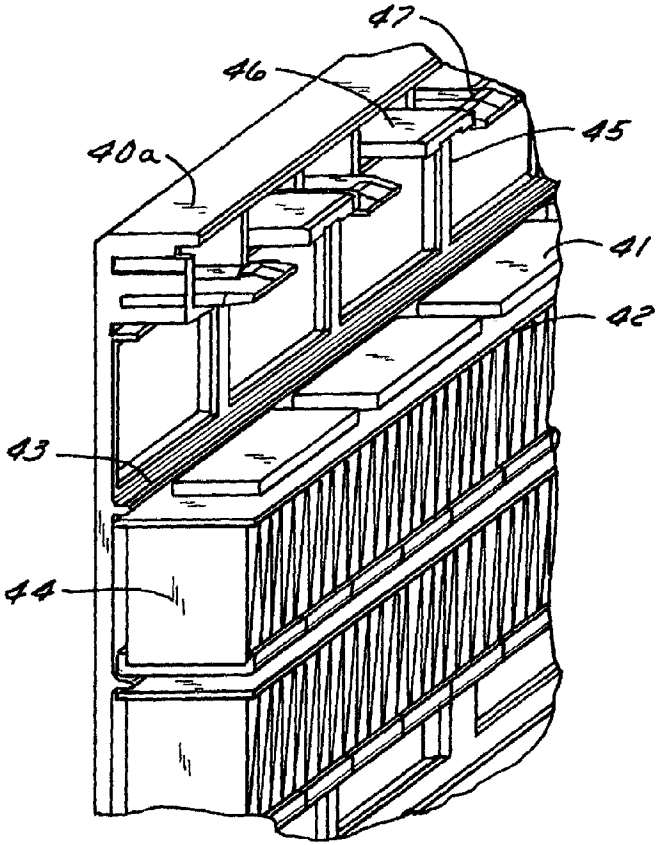
FIG. 9 a cutaway perspective view of an electric heating apparatus of the invention according to FIG. 8, but with only one of the half-shells of the housing shown.
Figure 8:
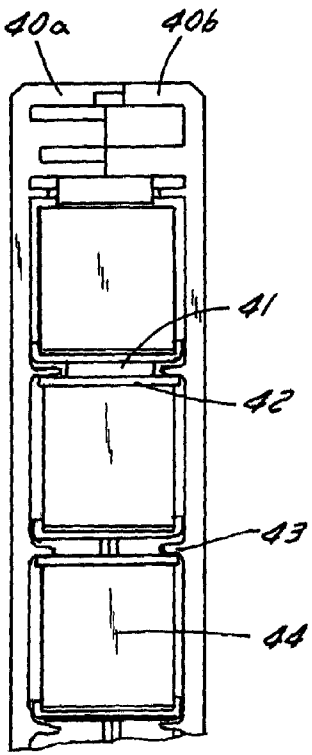
FIG. 8 a schematic sectional view through a heating apparatus of the invention, comprising a plastic housing and, arranged therein in several layers, PTC heating elements, contact sheets and radiators elements.
Figure 10:
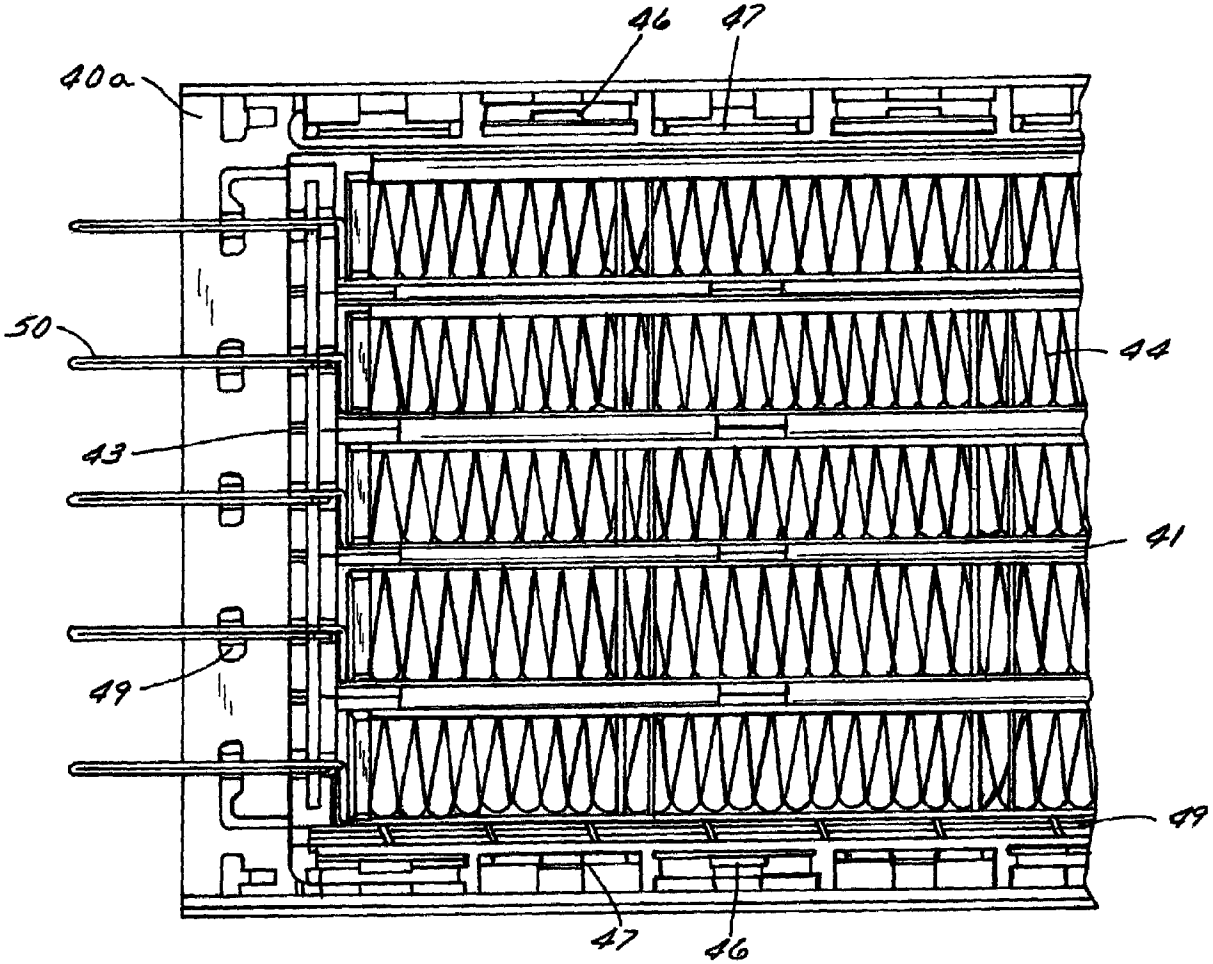
FIG. 10 a view on the heating apparatus of the invention according to FIG. 9 with the radiator elements, contact sheets, and PTC heating elements arranged in a half-shell.

FIGS. 8 through 10 show different views of an electric heating apparatus composed of several layers, according to one embodiment of the present invention. A sectional view through the electric heating apparatus is shown in FIG. 8, whereas FIG. 9 shows a perspective view, and FIG. 10 a top view on the components of the heating apparatus arranged in a half-shell of the housing. The housing consists of two inter-engaging half-shells 40*a* and 40*b*. The constructional units of the invention consisting of a radiator element 44, a contact sheet 42 connected thereto and heating elements 41 fixed to the contact sheet are arranged within said half-shells. The constructional units can each be inserted, separated by spacers 42, into one of the half-shells 40*a*, 40*b*.

Reinforcing elements are provided in each half-shell 40*a*, 40*b* of the housing for reinforcing the narrow longitudinal sides of the housing. Preferably, locking tabs 46, 47 will engage one another especially when the two housing halves 40*a*, 40*b* are put together. The narrow longitudinal sides of the housing are mechanically reinforced in this way and can therefore absorb increased clamping forces. Details and alternatives of a mechanically reinforced configuration of the narrow longitudinal sides of the housing will be explained with reference to subsequent figures.

The clamping pressure is produced via a resilient element 49 which compresses the layered structure of PTC elements 41, contact plates 42 and radiator elements 44, so that the electrical and thermal transition between the contact plates 42 and the PTC heating elements 41 is improved. This can enhance the efficiency of the heating apparatus.

The PTC heating elements 41 are pre-positioned on first contact sheets 42 via a lacquer. At the opposite sides of the PTC heating elements 41, a further contact sheet is provided during assembly. One of the two contact sheets contacting a PTC heating element is guided out of the housing 40 for electrical power supply, as shown in FIG. 10. The electric heating apparatus is supplied with power during operation via the contact tabs 50 of the guided-out contact sheets. For an easier assembly and reliable positioning of the contact tabs 50, which project out of the housing, each is held via positioning aids 49 on the housing sides.

Figure 11:
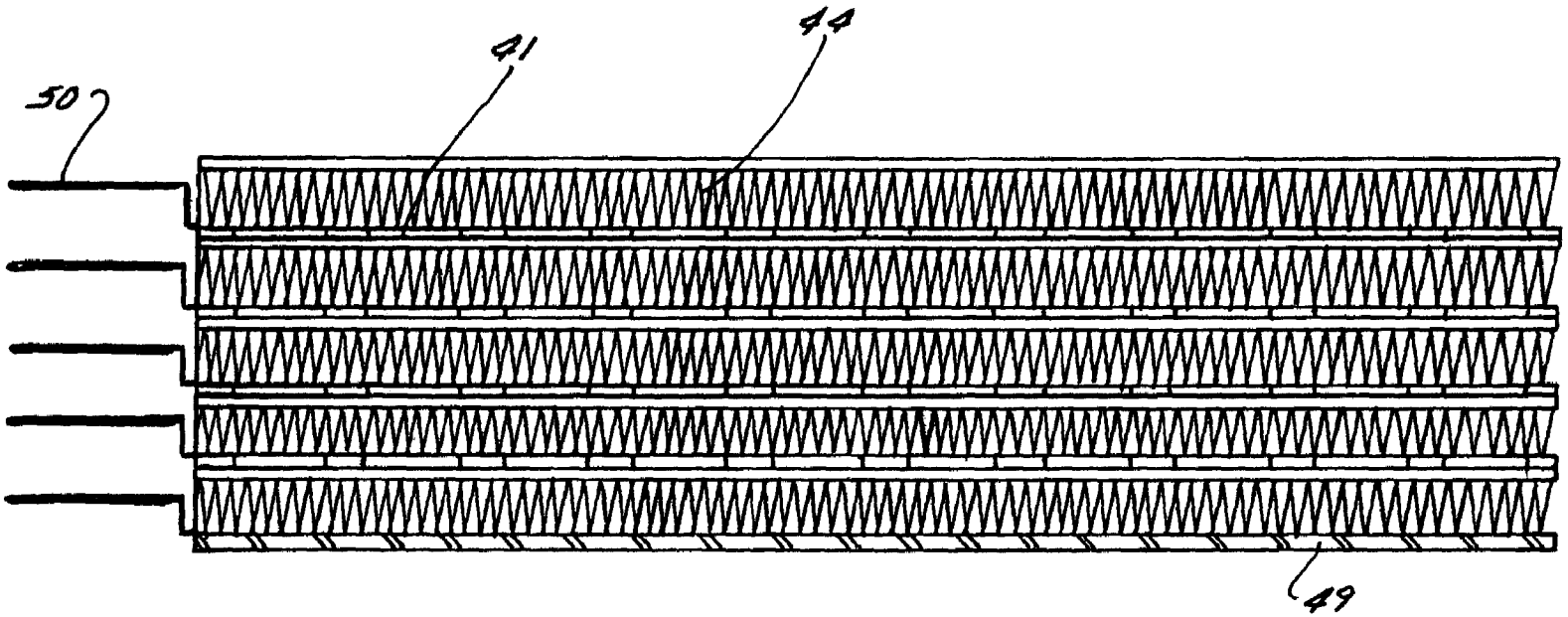
FIG. 11 a view of a layered construction of radiator elements, contact sheets and PTC heating elements, as arranged in the housing of an electric heating apparatus of the invention.

The layered structure of a plurality of constructional units, which is used in the housing 40, is shown in FIG. 11.

Figure 12:
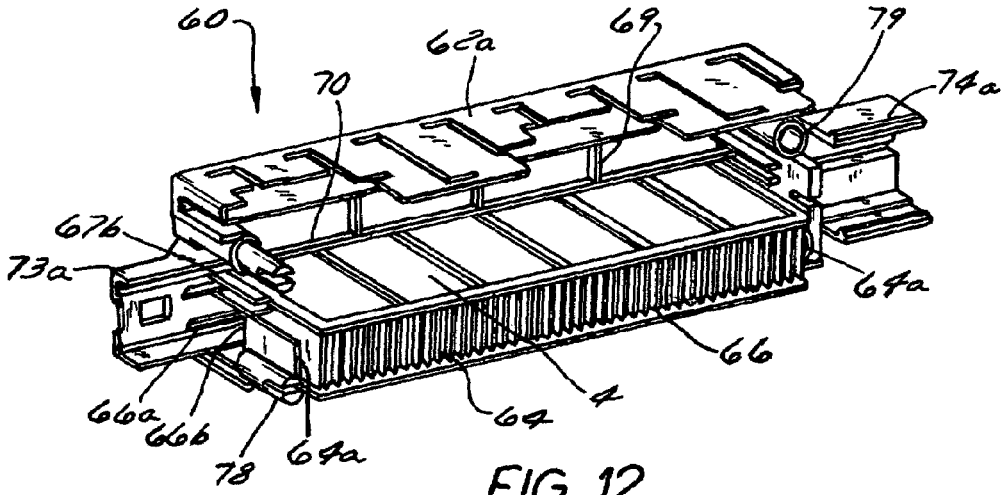
FIG. 12 a perspective view of a half-shell of the housing of the electric heating apparatus, which is only equipped in part.

FIGS. 12 to 15 show successive assembling stages of the heating apparatus according to the invention, the stages illustrating the structure of the heating apparatus according to the invention. FIG. 12 is a perspective view showing one half-shell 62*a* of the half-shells 62*a*, 62*b* of the housing. A contact sheet 66, a radiator element 64 and, next thereto, PTC heating elements 4 are inserted into the half-shell 62*a*. For an easy assembly guide rails or positioning means, respectively, are provided for all components. Especially the position of the contact plate 66 with the contact pin 66*a* is defined during insertion via guide 66*b* (and 67*b*, respectively, for contact plate 67 in FIG. 13). The radiator elements 64 are preferably designed in the form of corrugated rib elements. At one side the corrugated rib element is provided with a contact plate. Guides 64*a* are provided laterally in the inside of the housing for the ends of the contact plate of the corrugated rib element 64. Said guides solely serve to facilitate the assembly. In an alternative embodiment, they can thus be omitted as well.

Figure 13:
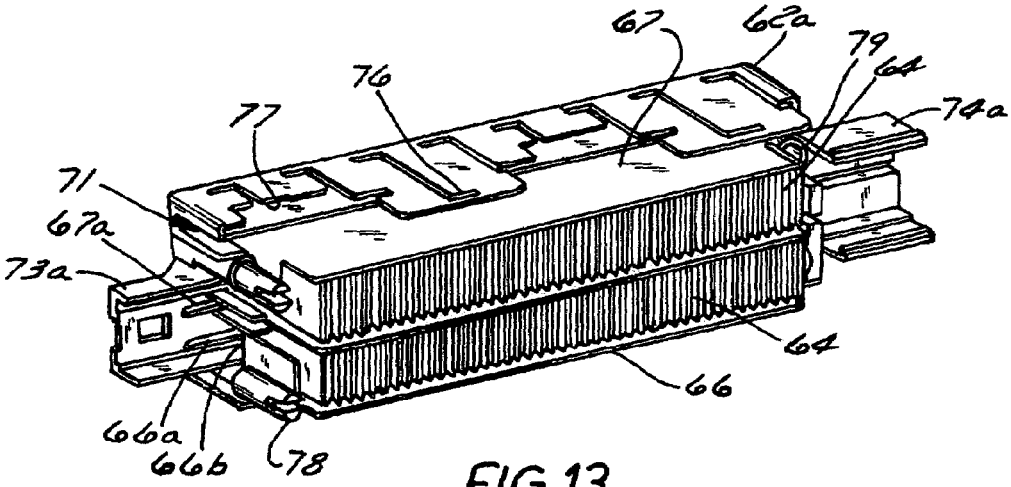
FIG. 13 a perspective view of a half-shell of the housing of the electric heating apparatus of FIG. 12, which is fully equipped.

As shown in FIG. 13, a radiator element 64 and a contact plate 67 with a plug contact 67*a* are again provided above the PTC heating elements 4, matching the structure shown in FIG. 12. The second half-shell 62*b* of the housing can be attached to the first half-shell 62*a* equipped in this way. Both half-shells of the housing are preferably configured such that their separation line extends approximately in the middle between the two elongate housing faces (which comprise the passage openings).

The assembly of the housing can particularly be simplified in that both half-shells 62*a*, 62*b* are provided with locking pins 78 and corresponding bores 79 in the respectively opposite half-shell. When the two half-shells are put together, they will lock as soon as the second half-shell 62*b* has been completely attached to the first half-shell 62*a*.

Figure 14:
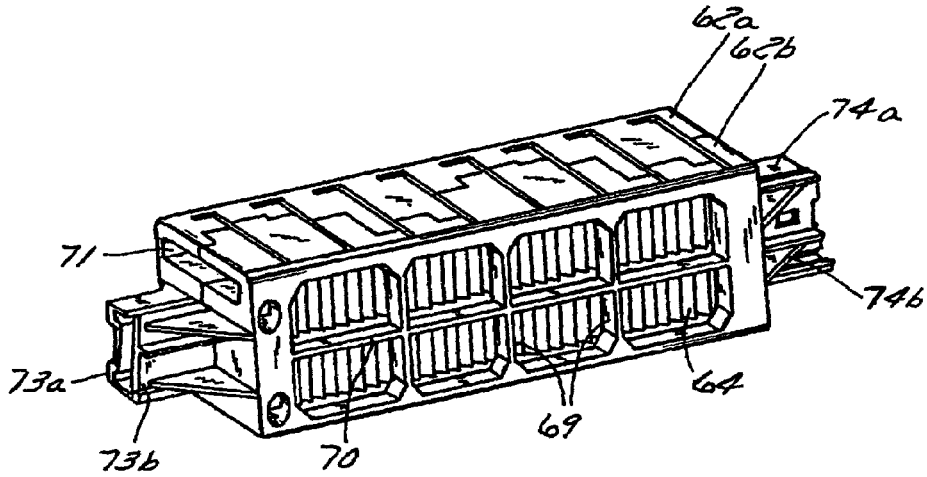
FIG. 14 a perspective view of the assembled housing of the electric heating; apparatus.

The assembled housing of the electric heating apparatus is again shown in FIG. 14. As can be seen in FIG. 14, each of the housing halves 62*a*, 62*b* is provided on the elongate faces with openings for the air flowing therethrough.

To enhance the efficiency of the heat generation by the PTC heating elements, said elements are kept clamped within the housing in the layered structure described with reference to FIGS. 12 and 13. This clamping action is effected by an additional resilient element 72. Preferably, the resilient element is inserted at least between an inner side of the housing and the layered structure. In addition, such a resilient element may also be inserted between the opposite inner side of the housing and the layered structure or at a place within the layered structure.

To enable the housing to absorb the clamping forces without deformation of the housing, the elongate housing faces are mechanically reinforced. The housing is not capable of absorbing high clamping forces between the mechanically reinforced housing faces, particularly in the area of the separation line.

To be able to absorb particularly high clamping forces, transverse struts 69 are provided inside the lateral opening for the air to be heated. Said transverse struts enable the housing to absorb sufficiently high clamping forces without any deflection or deformation of the housing. The half-shells with the struts are each made integral and are preferably made from plastics.

In a particularly advantageous embodiment, the transverse struts 69 are supplemented by one or more longitudinal struts 70, so that the struts 69 and 70 have the shape of a grid structure. With such a grid structure the transverse struts 69 can be made particularly thin and do not impede the air throughput. A bending up of the housing is efficiently prevented at the same time.

The stability of the housing between the mechanically reinforced faces of the housing is enhanced in an advantageous embodiment by a special design of the upper and lower sides of the half-shells. To this end projections 76 and recesses 77 are respectively provided on the upper and lower housing side of each half-shell 62*a*, 62*b*, and are arranged such that they engage into one another when put together. The mechanical stability of the upper and lower sides is thus also enhanced between the mechanically reinforced elongate housing faces by interconnection of the sides of the two half-shells.

Since it is only after assembly that the housing is capable of absorbing high clamping forces without any deformation of the housing, the resilient element 72 can only be inserted after assembly of the housing. To this end the housing 62 is provided on a housing side with an opening 71. Such an opening is preferably provided on the narrow sides of the housing 62. Each housing half 62*a*, 62*b* has corresponding recesses that in the assembled state of the housing 62 supplement one another to form an opening 71 for insertion of the resilient element 72. A special design of the inner sides of the housing for forming a resilient channel for the insertion of the resilient element 72 will be described in the following with reference to FIGS. 21 to 23.

The positioning means 64*a,* 66*b,* 67*b,* which are provided in the housing, are arranged such that the pre-positioned elements of the heating apparatus leave enough space for the resilient element. To be more specific, the pre-positioned elements are fixed with a play in the clamping direction effected by the resilient means to keep them movable and to absorb the clamping pressure generated by the resilient means.

Figure 15:
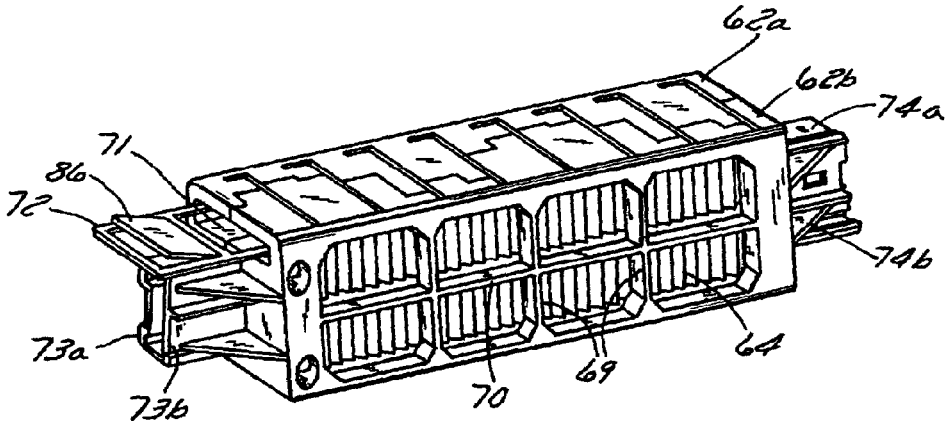
FIG. 15 a perspective view of the electric heating apparatus of FIG. 14, in which the resilient element is inserted in part.

As can be seen in FIG. 15, the resilient element 72 has a plurality of individual resilient segments for producing the clamping pressure. Preferred embodiments of the resilient element 72 will now be discussed in connection with FIGS. 26*a,* 26*b,* and 26*c.*

In the illustrated embodiments, the contact plates 66 and 67 are each arranged on the outside in the layered structure, so that the power supply takes place via the radiator elements 64 to the PTC heating elements 74. Said structure effects an excellent heat transition between the PTC heating elements 4 and the radiator elements 64 which output the heat to the air flowing therethrough, and heat conduction losses are therefore particularly small.

Thanks to the arrangement of the contact plates at the upper and lower ends of the layered structure of the elements of the heating apparatus, the air throughput is virtually not impeded. This makes it possible to keep the constructional height small without any reduction of the air passage volume.

Due to the design of the housing according to the invention with elongate housing faces that are made particularly stable from a mechanical point of view, the clamping forces are not received by the side bars of the holding frame in the conventional way. The narrow sides of the housing may therefore have any desired configuration. Preferably, the narrow sides of the housing can be designed such that they allow for a mechanical fixation and electrical contacting of the heating apparatus. For electrical contacting at least one narrow side of the housing can be adapted in any desired way to the geometry of a connector for the supply of power.

The design of the narrow sides is shown by way of example in FIGS. 12 to 15. At the left housing side a connector shape is formed from the projections 73*a,* 73*b* respectively formed on both housing halves. Connector tongues 66*a* and 67*a* of the two contact plates 66, 67 project into said connector. At the opposite side, a connector 14 is formed from the projections 64*a,* 64*b,* the connector essentially serving the mechanical fastening of the electric heating apparatus. Since the narrow sides of the housing 62 cannot absorb great forces, they can be designed in any desired way for mechanical and/or electrical fastening.

Figure 16:
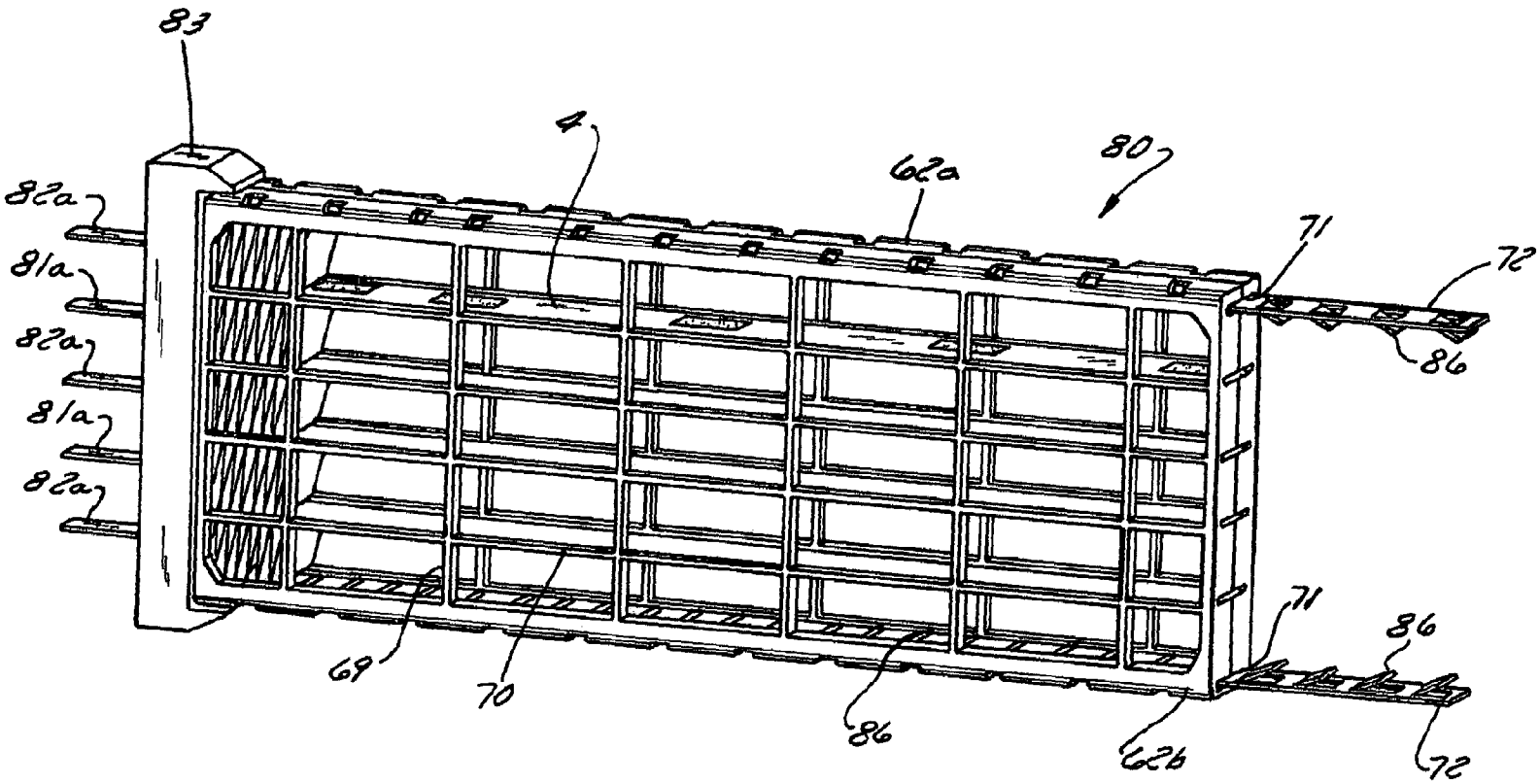
FIG. 16 a perspective view of another embodiment of the housing of the heating apparatus according to the invention.
Figure 17:
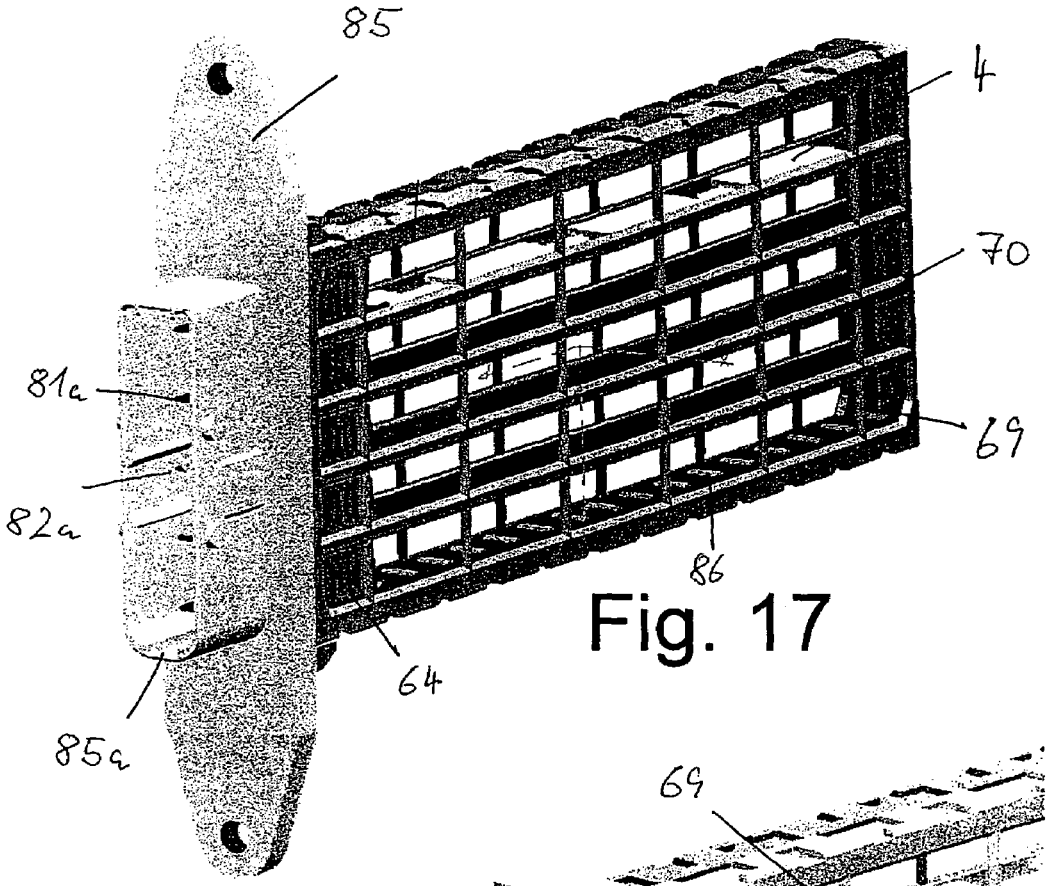
FIG. 17 a further perspective view of the embodiment shown in FIG. 16, in which the housing side, at which the contact pins are provided, is adapted by way of example to a special connector geometry.
Figure 18:
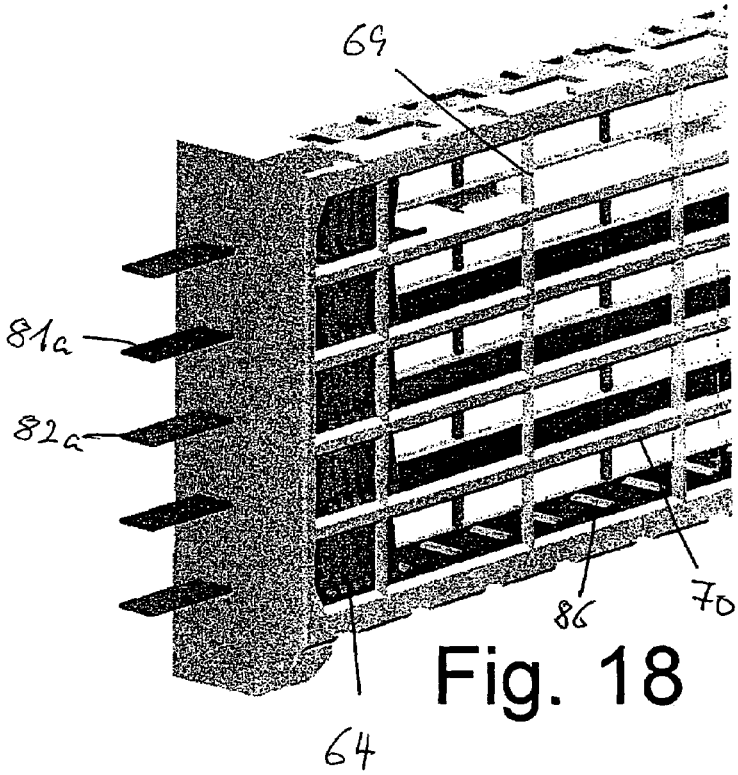
FIG. 18 a further detail view of the embodiment of the housing of the heating apparatus according to the invention according to FIG. 16.
Figure 19:
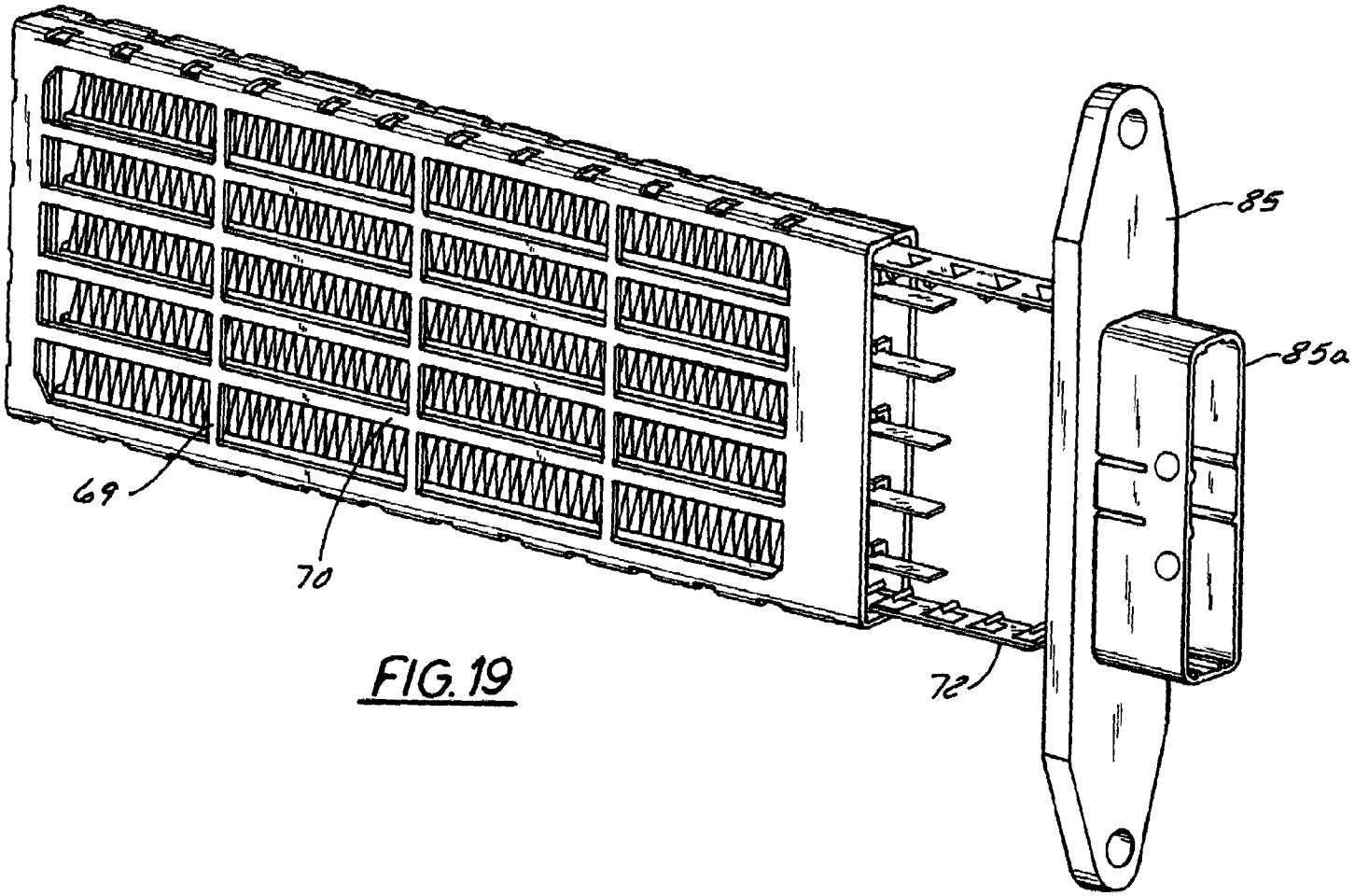
FIG. 19 a perspective view of a schematic illustration of a further embodiment of the heating apparatus according to the invention during assembly.

FIGS. 16 to 18 show a further embodiment of a housing and a corresponding electric heating apparatus. FIG. 16 shows a perspective view of an embodiment of an electric heating apparatus 80 which is made smaller than the embodiment of FIGS. 12 to 15, but has a larger cross-sectional area for a higher air throughput. To this end the heating apparatus comprises PTC heating elements 4 in a plurality of planes in the layered structure. In contrast to the embodiment of FIGS. 12 to 15, the PTC heating elements 4 having a rectangular shape are oriented with their longitudinal sides parallel to the elongate housing faces of the heating apparatus.

In accordance with each layer with PTC heating elements 4 in the layered structure consisting of radiator elements 64, PTC heating elements 4 and electrode sheets 81, 82, longitudinal struts 70 are respectively provided at the level of the layers with PTC heating elements 4. In the illustrated embodiment, a total of four layers with PTC heating elements 4 are present, and thus also four longitudinal struts 70. Due to the larger longitudinal extension of the heating apparatus in comparison with the heating apparatus of FIGS. 12 to 15, said embodiment also comprises a greater number of transverse struts 69.

In contrast to the first embodiment of FIGS. 12 to 15, two resilient elements 72 are used in the illustrated heating apparatus, the two elements being inserted at the upper end and lower end, respectively, on the narrow side of the housing. The resilient means are each inserted in such a way that the resilient segments 86 projecting from the resilient element 72 protrude from the housing surface towards the layered structure. Although this is not shown, further resilient elements 72 can also be inserted between the two illustrated resilient positions into the layered structure.

On account of the plurality of the layers illustrated in this embodiment with PTC heating elements 4, a correspondingly higher number of contact sheets is needed. The uppermost and lowermost ones of the contact sheets 82 are arranged next to the upper housing inside and the lower housing inside, respectively. The three middle contact sheets are each arranged next to the three lower layers with PTC heating elements, i.e. matching the three lower ones of the longitudinal struts 70.

Each of the contact sheets 81, 82 has contact tongues 81*a,* 82*a* projecting out of the frame. The housing side 83 from which the contact tongues 81*a,* 82*a* are projecting may have any design. A particular embodiment is shown in FIG. 17. The housing 83 as shown in FIG. 16 has attached or adhered thereto an individually adapted connector shape 85. Said adhered connector shape can be adapted to the respective requirements, e.g. for installation of the heating apparatus in vehicles of different car manufacturers using different types of plug contacts. In the embodiment shown in FIG. 17, the attachable connector attachment 85 consists of a mechanical stop with fastening holes and a connector shoe 85*a* in which the contact tongues 81*a,* 82*a* are arranged.

Preferably, transverse struts 69 of the grid structure are arranged at a distance of 30 to 40 mm. At a distance of the transverse struts greater than 40 mm, particularly starting from about 60 mm, the clamping forces can no longer be received to an adequate extent by the transverse struts. By contrast, below a distance of the transverse struts of less than 30 mm, particularly less than 20 mm, these impede the air throughput through the elongate faces of the heating apparatus.

Figure 21:
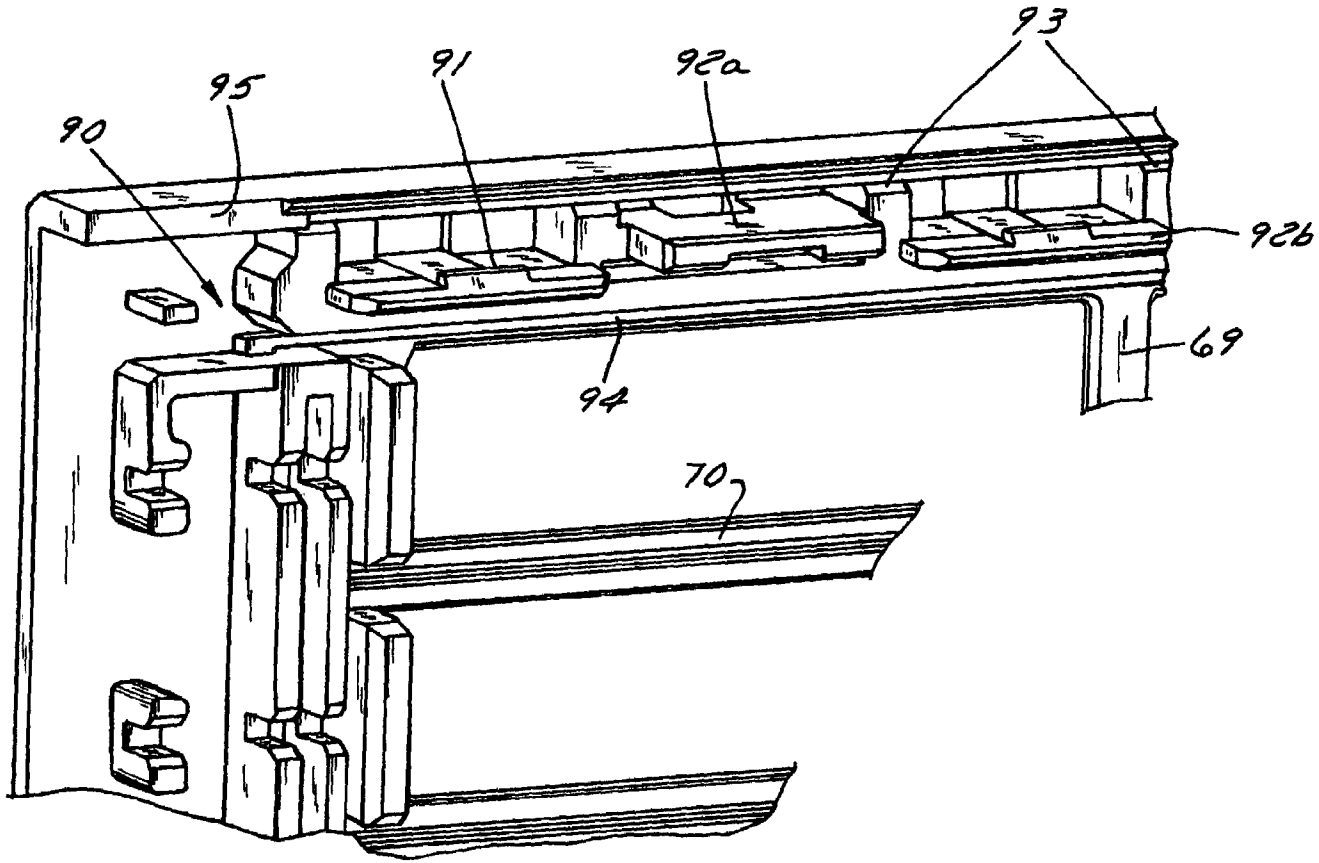
FIG. 21 a detail view of the inner side of a half-shell of the housing of a further embodiment of the invention.
Figure 23:
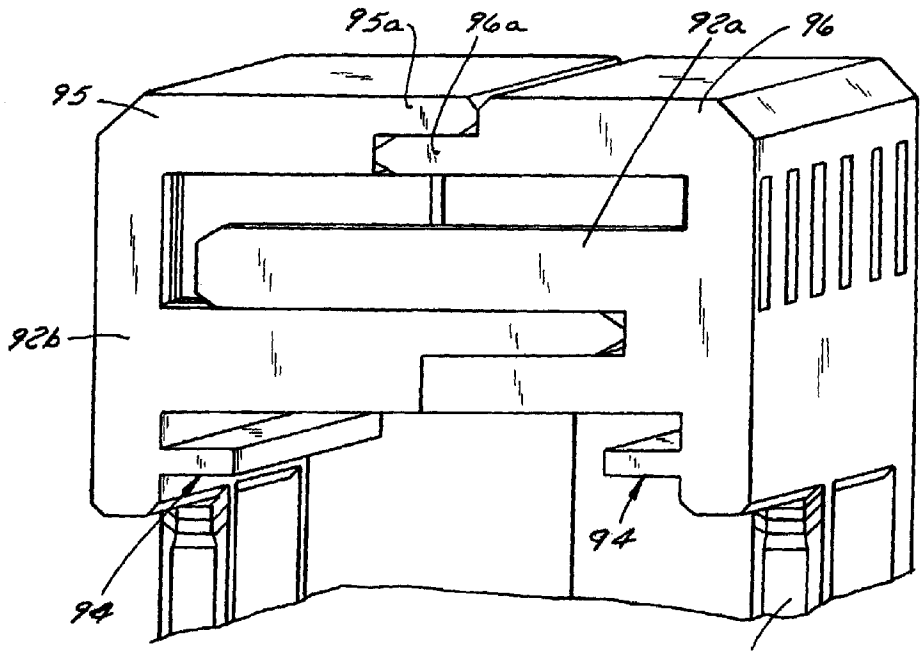
FIG. 23 an enlarged view of a detail of the illustration of the housing of FIG. 22, wherein the details of the interconnected construction of the housing side for a stronger mechanical load-carrying capacity of the longitudinal housing sides can clearly be seen.
Figure 22:
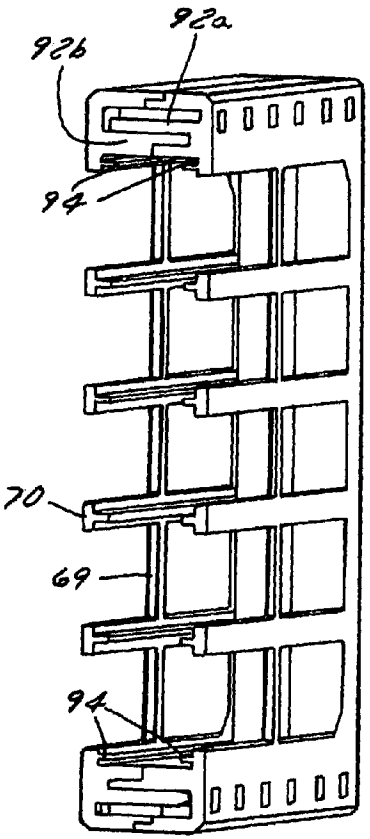
FIG. 22 a sectional view through the assembled half-shells of the housing according to the embodiment of FIG. 21.

FIGS. 21 to 23 show a particular embodiment for the design of the insides of the two half-shells of the housing. The inner structure of the half-shells comprises a resilient channel into which the resilient means 72 can be inserted after assembly of the two half-shells of the housing. The resilient channel effects a guiding of the resilient means during insertion, namely via laterally extending grooves. The grooves are e.g. formed by projections 94 and either by the upper side of the housing or, like in the illustrated embodiment, via locking tabs 92*a,* 92*b.*

The projection 94 forms not only one side of the resilient channel for the insertion of the resilient means, but also serves as a positioning aid of the elements of the heating apparatus. These are (pre-)fixed by the projection 94 with a play in the housing around an insertion channel for the resilient means to be inserted after assembly.

Furthermore, the embodiment shown in FIGS. 21 to 23 has an increased stiffness. Such an additional stiffening may be required, for instance for the following reasons. To achieve a high efficiency also in the case of "large-area heating apparatuses", i.e. heating apparatuses that are small, but formed with a large area for a high air throughput, very high clamping forces are needed. However, at housing temperatures of about 170° C., the stiffness of the used plastic material is decreasing. Moreover, the resilient means can transmit the force not only to the edge of the housing because the resilient segments used have a minimum distance of about 2 mm to 2.5 mm from the edge of the resilient means. However, to prevent a deflection of the upper and lower housing sides, said sides are preferably stiffened in addition. To this end, oppositely arranged locking tabs 92*a*, 92*b* are respectively provided in both half-shells of the housing. Each of the locking tabs projects in the direction of the opposite housing half, and they are interlocked via locking noses 91 during assembly. Thanks to this toothing on the upper and lower housing sides, the mechanical stiffness thereof is enhanced and deflection is avoided.

A further increase in stiffness can be achieved through an additional side wall 95, 96. Said side wall 95, 96 is respectively arranged above the former side walls and connected thereto via supporting elements 93. The mechanical stiffness of the upper and lower sides can thereby be increased such that the housing can receive particularly high clamping forces. This permits a "large-area construction", i.e. a heating apparatus having a large number of superimposed layers of PTC elements and interposed radiator elements.

Figure 24:
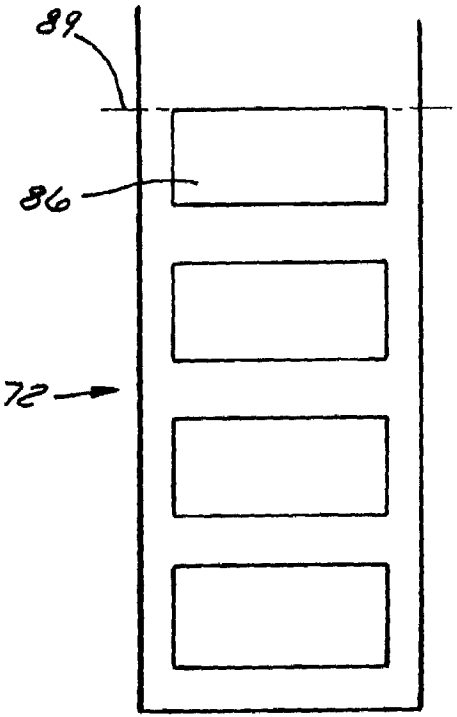
FIG. 24 a schematic illustration of a top view on the resilient element according to the invention.

The construction of the resilient element 72 will be described in the following with reference to FIGS. 24, 25 and 26. FIG. 24 shows a top view on the resilient element 72, FIG. 25 a side view, and FIG. 26 a perspective view of the resilient element 72.

The resilient element 72 consists of a sheet member 85 and resilient segments 86 projecting therefrom. Preferably, the resilient element 72 is made integral, each of the resilient segments being punched on three sides out of the sheet member 85 and bent around an axis 89 in the transverse direction of the sheet member 85. The angle $\alpha$ around which the punched segments are bent out is approximately between 5° and 30°, preferably between 15° and 20°. This construction of the resilient element 72 prevents a deflection in transverse direction and only allows one in longitudinal direction. As a result, the resilient element only acts on the housing edge on which it is supported during generation of the clamping force. Thus the resilient means ideally cooperates with the housing, which on account of its construction can only receive large forces in the housing sides and is less capable of bearing loads in the middle in the area of the separation line. Preferably, the lateral ends of the resilient segments are arranged very close to the edge of the resilient element for this purpose.

Figure 26:
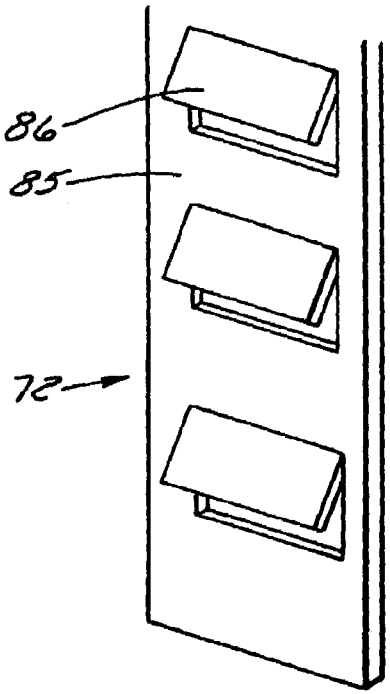
FIG. 26 a schematic illustration of a perspective view of the resilient element according to the invention.
Figure 25:
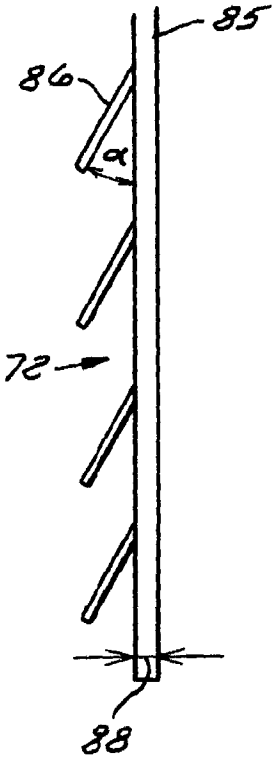
FIG. 25 a schematic illustration of a side view on the resilient element according to the invention.

The illustration in FIGS. 24, 25, and 26 is just a schematic one. The resilient segments 86 need not be rectangular, but may also have areas of different width and inclination. For instance, each resilient segment may have a broader end section which is slightly flattened to allow the resilient element to be pushed into the housing in an improved way.

Figure 20:
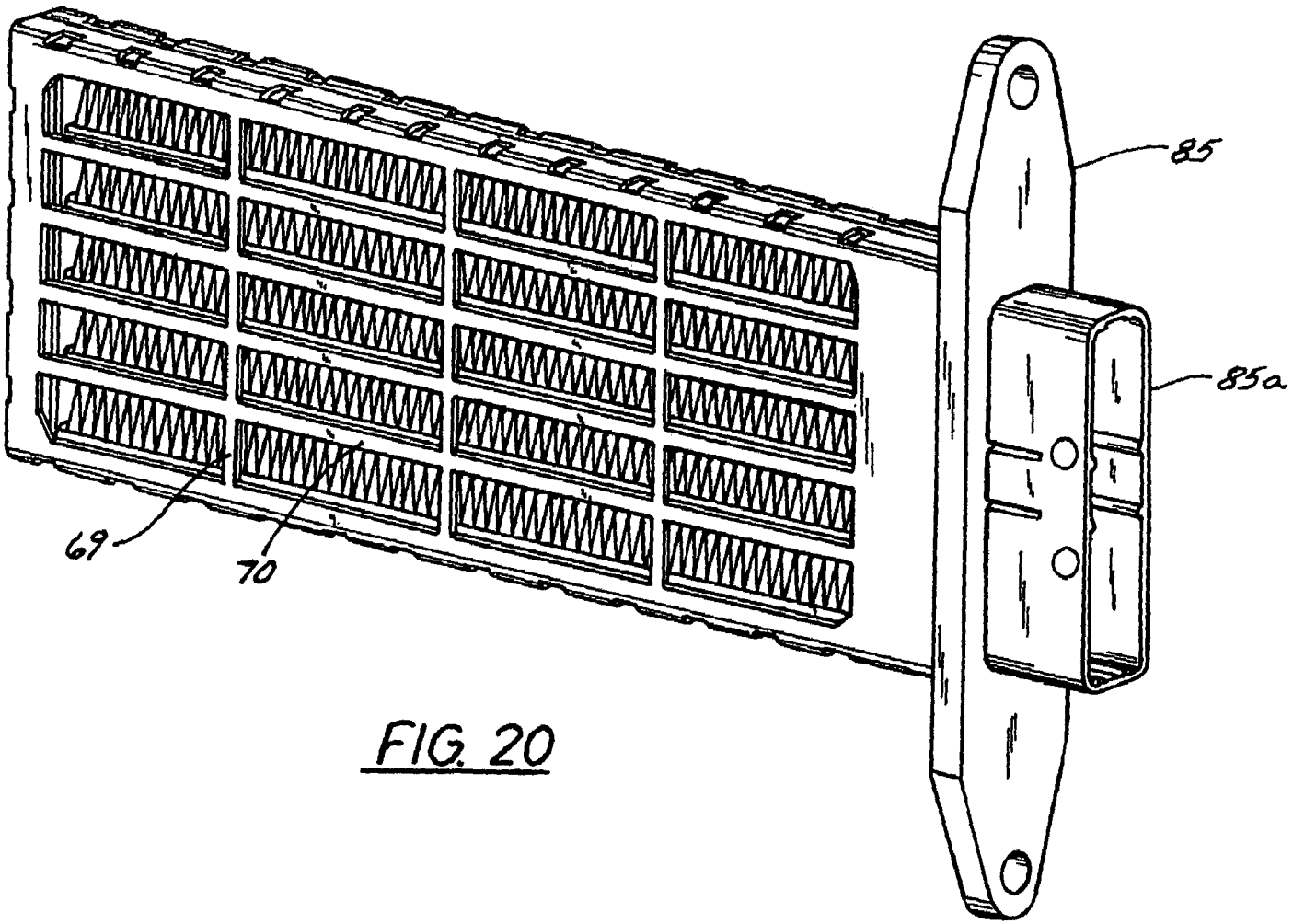
FIG. 20 a perspective view of the assembled embodiment according to FIG. 19.
Figure 27A:
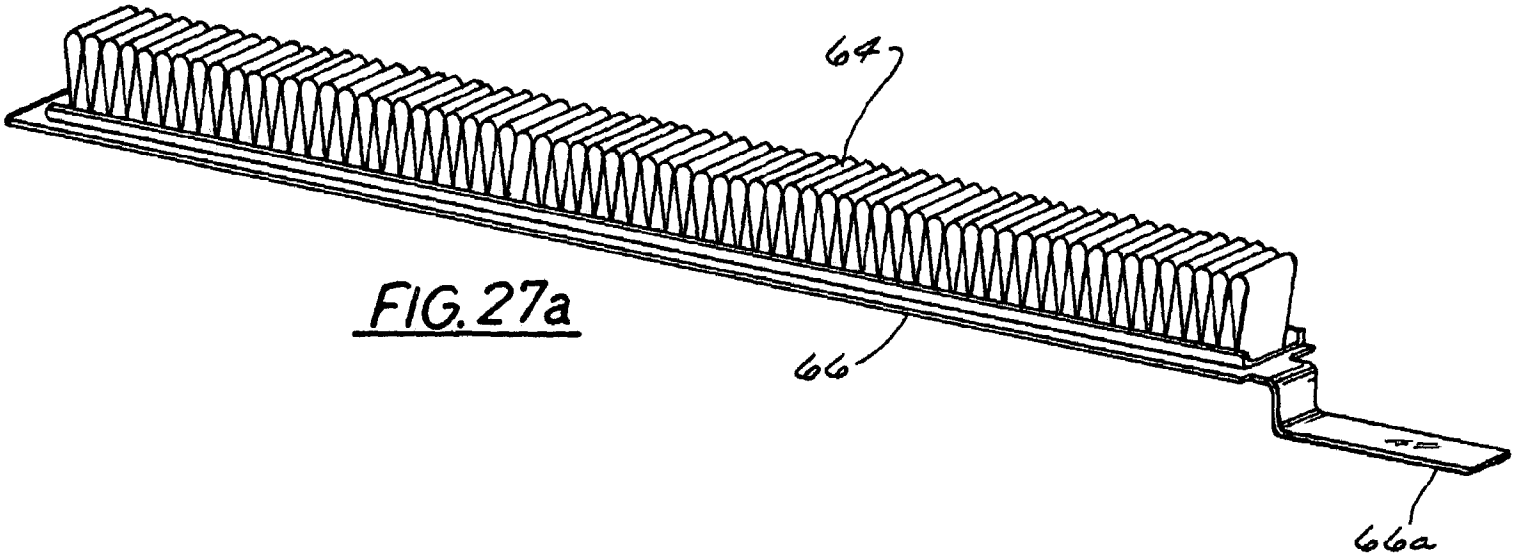
FIG. 27*a* a view of a corrugated rib element with a contact sheet attached to said element.
Figure 27B:
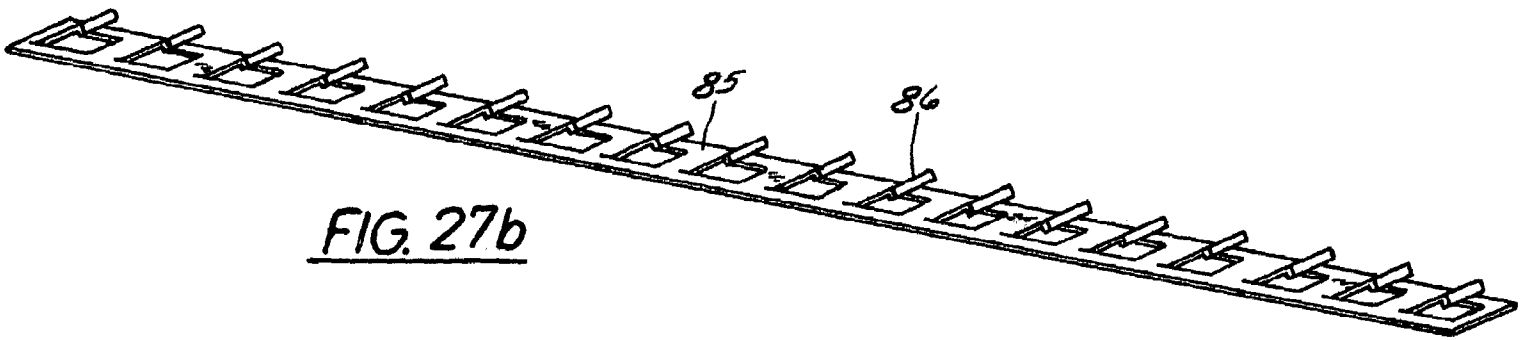
FIG. 27*b* a view of a further design of the resilient element.

FIG. 27*a* shows a radiator element 64 and a contact sheet 66 connected thereto in an elongate embodiment for a "large-area heating apparatus" (e.g. according to FIG. 20). The corresponding resilient element is shown in FIG. 27*b*. The resilient element has a number of successively arranged resilient segments 86. Each of the resilient segments 86 is able to exert a contact pressure force of about 15 N. For enhancing the contact pressure force the resilient segments according to FIG. 27*b* are tightly positioned one after the other such that two or more resilient segments 86 are arranged across the surface of a PTC element. This doubles or even triples the clamping pressure. In contrast to conventional frame mountings, the clamping pressure is here evenly exerted over the whole length of the resilient means.

To enable the housing to absorb the clamping forces generated by the resilient segments 26, the elongate faces of the housing can be equipped with transverse struts 69 such that two to not more than five resilient segments 86 are arranged between two successive transverse struts 69.

The embodiment according to FIG. 15 shows a resilient element 72 with two or more adjacently arranged resilient segments. This embodiment is advantageous in the case of shapes of housings that have a large depth.

While resilient means of a thickness of about 0.8 mm are used in the conventional way, resilient elements having a thickness of 0.2 to 0.5 mm, preferably about 0.3 mm, are employed in the new constructional principle. This effects a resilient action of the resilient segments 86 also at a small length of a resilient segment.

A special advantage of the heating apparatus of the invention is that the resilient element can be produced as an endless member for the first time and can thus be supplied from a roll during manufacture. Conventionally, each resilient segment is made separately and produced individually for all of the different heating apparatus lengths. Moreover, it suffices to provide only one resilient element per heating apparatus.

Apart from the small constructional height, a special advantage of the heating apparatus of the invention is that said heating apparatus can be produced in a particularly simple way. The heating apparatus is assembled as described in connection with FIGS. 12 to 15. According to the invention the individual elements are assembled—in contrast to conventional heating apparatuses—without the clamping forces acting on the layered structure. It is only after assembly of the housing that the resilient means is slid into the assembled housing (cf. FIG. 15).

To sum up, the invention refers to a new constructional principle for electric heating apparatuses in which the functions of frame and resilient means are separated from one another. A housing is used as a frame for an electric heating apparatus, the housing consisting of two half-shells. Positioning aids for the PTC heating elements are arranged in the housing. The longitudinal sides of the housing are made substantially open to allow air throughput through the heating register.

Prior to assembly of the heating apparatus, the PTC heating elements are fastened via a lacquer to a contact sheet contacting the PTC heating elements. The constructional units prefabricated in this way facilitate assembly and do not require additional positioning means for arranging the PTC heating elements in a correct position during manufacture. In addition, the lacquer provides protection against penetrating moisture. An efficient corrosion protection is thereby achieved at the same time.

In addition, a resilient means which compresses the layered structure of radiator elements, PTC heating elements and contact sheets is additionally inserted into the housing. The resilient means can be slid into the housing at a later time through an opening provided laterally in the housing. As a result, the housing will only be exposed to resilient forces after assembly when it can be loaded mechanically.

The new constructional principle has a number of advantages. On the one hand, the weight can be reduced considerably at the same heating capacity with the construction according to the invention, as no metal frame is used, i.e. up to about 50 percent. Moreover, without additional measures and without additional weight, the heating apparatus has no exposed metal surfaces. A further advantage is the low constructional height that is up to about 30 percent below that of the conventional heating apparatuses. It is thus possible to realize also much smaller heaters than in the prior art, the heaters nevertheless achieving a high efficiency due to the clamping principle employed for increasing electrical and thermal contacting. Moreover, it is also possible to produce longer heating elements that with the conventional holding frame construction can only be realized under great efforts.

Moreover, a conventional positioning frame is not used for keeping the PTC heating elements spaced apart and for protecting the same, but the PTC heating elements are fixed via a lacquer by being pre-positioned on the contact plate and are separated from one another.

Moreover, the manufacturing efforts are considerably reduced in comparison with conventional heating apparatuses. The manufacture of the heating apparatus of the invention is much easier because no special device is needed for overcoming the resilient forces of the frame in the production process.

The constructional principle requires no special design of the side bars of a holding frame for absorbing the clamping force acting on the longitudinal bars. The narrow sides of the housing of the invention can thus be adapted in their design to any desired connector geometry surrounding the connector tongues of the contact sheets projecting from the housing.

In addition, the resilient means can thereby be produced at considerably lower costs. On the one hand, the thickness of the resilient means can be reduced and material can thus be saved. On the other hand, the resilient element can now be produced for the first time as a continuous member and supplied from a roll during manufacture. Moreover, a single resilient member is sufficient.

We claim:

1. An electric heating apparatus comprising:

a housing which has openings on elongate housing faces, and a layered structure including at least one PTC heating element, a radiator element, first and second contact sheets for power supply and a resilient element, the PTC heating element being arranged between the first and second contact sheets and the layered structure being kept clamped in the housing by the resilient element, wherein the first contact sheet is provided with a lacquer layer at the side facing the PTC heating element, and a space between the PTC heating element and the first contact sheet is sealed via lacquer pressed out of said space.

2. The electric heating apparatus according to claim 1, wherein the lacquer is an electrically non-conductive silicone lacquer.

3. The electric heating apparatus according to claim 1, wherein the lacquer has a viscosity lower than 900 mPa.S.

4. The electric heating apparatus according to claim 3, wherein the lacquer has a viscosity of about 800 mPa.S.

5. The electric heating apparatus according to claim 1, wherein the first contact sheet is made from aluminum.

6. The electric heating apparatus according to claim 1, wherein the second contact sheet is made from brass.

7. The electric heating apparatus according to claim 1, wherein the second contact sheet is tin-plated.

8. The electric heating apparatus according to claim 1, wherein an opening is provided in the housing for inserting the resilient element.

9. The electric heating apparatus according to claim 1, wherein a resilient channel formed in the housing for receiving the resilient element.

10. The electric heating apparatus according to claim 1, further comprising positioning means for pre-fixing the elements of the heating apparatus in the housing.

11. The electric heating apparatus according to claim 1, wherein the elongate faces of the housing are mechanically reinforced by at least one transverse strut.

12. The electric heating apparatus according to claim 11, wherein the struts in the elongate faces of the housing have the shape of a grid structure.

13. The electric heating apparatus according to claim 12, wherein the grid structure has at least one longitudinal strut in the area of the PTC heating elements.

14. The electric heating apparatus according to claim 1, wherein said housing is made from plastics.

15. The electric heating apparatus according to claim 1, wherein the housing comprises two half-shells.

16. The electric heating apparatus according to claim 15, wherein the half-shells of the housing can be put together.

17. The electric heating apparatus according to claim 16, further comprising locking pins or locking noses which, when the half-shells of the housing are put together, effect a locking of the two half-shells.

18. The electric heating apparatus according to claim 16, wherein the half-shells are configured such that they separate the housing approximately in the middle between the elongate faces of the housing.

19. The electric heating apparatus according to claim 18, wherein respectively opposite projections provided on the separation line of the half-shells, which will engage each other when the half-shells are assembled.

20. The electric heating apparatus according to claim 1, wherein the resilient element is configured such that it transmits the clamping forces essentially onto the reinforced longitudinal sides of the housing.

21. The electric heating apparatus according to claim 1, wherein the resilient element consists of a sheet member with resilient segments projecting therefrom.

22. The electric heating apparatus according to claim 20, wherein each of the resilient segments extends into the edge portions of the longitudinal sides of the resilient member.

23. The electric heating apparatus according to claim 21, wherein the resilient member is made integral with the resilient segments.

24. The electric heating apparatus according to claim 1, further comprising at least one resilient segment for generating clamping forces is provided at each PTC heating element position for a frictional clamping action.

25. The electric heating apparatus according to claim 24, wherein at least two resilient segments are provided for each PTC heating element position.

26. The electric heating apparatus according to claim 1, wherein the heating apparatus comprises an auxiliary heater for automotive vehicles.

27. A constructional unit for an electric heating apparatus, comprising:

a housing which has openings on elongate housing faces, and a layered structure including at least one PTC heating element, a radiator element, first and second contact sheets for power supply, and a resilient element, the PTC heating element being arranged between the first and second contact sheets and the layered structure being kept clamped in the housing by the resilient element, wherein the constructional unit is formed from the first contact sheet and a PTC heating element, the first contact sheet being provided with a lacquer layer at the side facing the PTC heating element, and a space between the PTC heating element and the first contact sheet being sealed via lacquer pressed out of said space.

28. The constructional unit according to claim 27, wherein the lacquer is an electrically non-conductive silicone lacquer.

29. The constructional unit according to claim 27, wherein the lacquer has a viscosity lower than 900 mPa.S.

30. The constructional unit according to claim 27, wherein the lacquer has a viscosity of about 800 mPa.S.

31. The constructional unit according to claim 27, wherein the first contact sheet is made from aluminum.

32. The constructional unit according to claim 30, wherein the second contact sheet is made from brass.

33. The constructional unit according to claim 28, wherein the second contact sheet is tin-plated.

34. The constructional unit according to claim 27, wherein the unit is for an auxiliary heater for automotive vehicles.

35. A method for producing an electric heating apparatus that includes:

a housing having two half-shells with openings on elongate faces of the housing, and a layered structure including at least one PTC heating element, a radiator element, first and second contact sheets for power supply, and a resilient element, the layered structure being kept clamped by the resilient element in the housing, the method comprising:

fastening a PTC heating element to the first contact sheet via a lacquer, inserting the first contact sheet with the PTC heating element fastened thereto and the second contact sheets into a first half-shell of the housing, and attaching the second half-shell of the housing to the first half-shell.

36. The method according to claim 35, wherein the lacquer is an electrically non-conductive silicone lacquer.

37. The method according to claim 35, wherein the lacquer has a viscosity lower than 900 mPa.S.

38. The method according to claim 35, wherein the lacquer has a viscosity of about 800 mPa.S.

39. The method according to claim 35, wherein the fastening of the PTC heating element via the lacquer only withstands small mechanical loads.

40. The method according to claim 35, wherein the resilient element is inserted through an opening of the assembled housing to effect clamping of the layered structure.

41. The method according to claim 35, wherein, along with the insertion of the resilient element, the lacquer is pressed out of the area between the PTC heating elements and the contact sheet via the contact pressure generated by the resilient element.

42. The method according to claim 35, wherein the lacquer pressed out of the area between the PTC heating element and the contact sheet seals said area against penetrating moisture.

43. The method according to claim 35, wherein the first contact sheet is made from aluminum.

44. The method according to claim 35, wherein the second contact sheet is made from brass.

45. The method according to claim 35, wherein the second contact sheet is tin-plated.

46. The method according to claim 35, wherein an auxiliary heating unit for automotive vehicles is produced.

47. An auxiliary electric heater for automotive vehicles, comprising:

a housing which has elongate housing faces having openings formed therein, and a layered structure including at least one PTC heating element, a radiator element, first and second contact sheets, and a resilient element, the PTC heating element being arranged between the first and second contact sheets and the layered structure being clamped in the housing by the resilient element, wherein the first contact sheet is provided with a lacquer layer at a side thereof facing the PTC heating element, and wherein a space between the PTC heating element and the first contact sheet is sealed via lacquer pressed out of the space.

48. The electric heating apparatus according to claim 47, wherein the lacquer is an electrically non-conductive silicone lacquer.

49. The electric heating apparatus according to claim 47, wherein the lacquer has a viscosity lower than 900 mPa.S.

50. The electric heating apparatus according to claim 49, wherein the lacquer has a viscosity of about 800 mPa.S.

* * * * *